US006154623A

United States Patent [19]

Suzuki et al.

[11] Patent Number: 6,154,623

[45] **Date of Patent: *Nov. 28, 2000**

[54] PROCESS CARTRIDGE AND IMAGE FORMING APPARATUS

[75] Inventors: Akira Suzuki, Odawara; Tadayuki Tsuda, Susono; Shigeo Miyabe, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,133

[22] Filed: Sep. 19, 1997

[30] Foreign Application Priority Data

Sep. 20, 1996 [JP] Japan ..... 8-271561
Aug. 22, 1997 [JP] Japan ..... 9-242210

[51] Int. Cl.[7] ..... G03G 15/00; G03G 21/00

[52] U.S. Cl. ..... 399/111

[58] Field of Search ..... 399/111, 115, 399/116, 117, 119

[56] References Cited

U.S. PATENT DOCUMENTS 5,331,373 7/1994 Nomura et al. ..... 399/111
5,450,166 9/1995 Yashiro ..... 399/111
5,452,056 9/1995 Nomura et al. ..... 399/111
5,500,714 3/1996 Yashiro et al. ..... 399/111
5,543,891 8/1996 Setoriyamo ..... 399/111
5,585,889 12/1996 Shishido et al. ..... 399/113
5,749,027 5/1998 Ikemoto et al. ..... 399/111 X
5,774,766 6/1998 Karakama et al. ..... 399/111
5,794,103 8/1998 Oh ..... 399/119
5,878,309 2/1999 Nomuro et al. ..... 399/111

*Primary Examiner*—Fred L Braun
*Attorney, Agent, or Firm*—Fitzpatrick, Cella, Harper & Scinto

[57] ABSTRACT

A process cartridge detachably mountable to a main body of an electrophotographic image forming apparatus includes an electrophotographic photosensitive member, a developing unit for developing a latent image formed on the electrophotographic photosensitive member with a toner, a toner containing portion for containing the toner used by the developing unit, and a recess formed in an outer surface of the toner containing portion over an entire area thereof substantially in parallel with an axis of the electrophotographic photosensitive member for gripping the process cartridge.

35 Claims, 10 Drawing Sheets

PROCESS CARTRIDGE AND IMAGE FORMING APPARATUS

BACKGROUND OF THE INVENTION

1. Field of the Invention

The present invention relates to a process cartridge and an electrophotographic image forming apparatus to which such a process cartridge can detachably be mounted.

The electrophotographic image forming apparatus is an apparatus to form an image on a recording medium by using an electrophotographic image forming system. Such an electrophotographic image forming apparatus may be an electrophotographic copying machine, an electrophotographic printer (LED printer, laser beam printer or the like), an electrophotographic facsimile machine, an electrophotographic word processor or the like.

The process cartridge may incorporate therein at least a developing means, and an electrophotographic photosensitive drum as a cartridge unit, which can removably be mounted to the image forming apparatus, or may incorporate therein at least one of a charge means and a cleaning means (in addition to the developing means), and an electrophotographic photosensitive drum as a cartridge unit, which can removably be mounted to the image forming apparatus.

2. Related Background Art

In conventional electrophotographic image forming apparatuses using an electrophotographic image forming process, a process cartridge in which an electrophotographic photosensitive member and process means acting thereon are integrally incorporated into a cartridge unit which can removably be mounted to the main body of an image forming apparatus has been utilized. By using such a process cartridge, since the maintenance of the apparatus can be performed by the user himself without any expert, the operability is considerably improved. Thus, the process cartridges have widely been used in electrophotographic image forming apparatuses.

In such process cartridges, a grip portion is provided for permitting good mounting and dismounting of the process cartridge with respect to a main body of the electrophotographic image forming apparatus (for example, refer to U.S. Pat. No. 5,500,714).

SUMMARY OF THE INVENTION

An object of the present invention is to provide a process cartridge and an electrophotographic image forming apparatus to which such a process cartridge can detachably be mounted, in which such a process cartridge can effectively be mounted to and dismounted from a main body of such an electrophotographic image forming apparatus.

Another object of the present invention is to provide a process cartridge and an electrophotographic image forming apparatus to which such a process cartridge can detachably be mounted, in which mounting and dismounting operability can be improved.

A further object of the present invention is to provide a process cartridge having a grip portion which can be gripped by an operator, and an electrophotographic image forming apparatus to which such a process cartridge can detachably be mounted.

A still further object of the present invention is to provide a process cartridge having a recessed portion which is formed in an outer surface of a toner containing portion for containing toner along an entire width thereof in an axial direction of an electrophotographic photosensitive member and which can be gripped by an operator, and an electrophotographic image forming apparatus to which such a process cartridge can detachably be mounted.

A further object of the present invention is to provide a process cartridge and an electrophotographic image forming apparatus to which such a process cartridge can detachably be mounted, in which such a process cartridge can surely be mounted at a predetermined mounting position.

A still further object of the present invention is to provide a process cartridge having a recessed portion which is formed in an outer surface of a toner containing portion for containing toner along an entire width thereof in an axial direction of an electrophotographic photosensitive member and which can be gripped by an operator, and an electrophotographic image forming apparatus to which such a process cartridge can detachably be mounted, in which such a process cartridge is mounted and dismounted with respect to such an image forming apparatus in a direction transverse to an axis of the photosensitive member.

Another object of the present invention is to provide a process cartridge, and an electrophotographic image forming apparatus to which such a process cartridge can detachably be mounted, in which such a process cartridge has a force receiving portion for receiving a force for returning the process cartridge to a predetermined mounting position if the process cartridge is deviated from the predetermined mounting position and the force receiving portion is positioned at a downstream side of the aforementioned recessed portion in a mounting direction of the process cartridge to the image forming apparatus and is capable of abutting against an opening/closing member of the image forming apparatus when the opening/closing member is closed.

DETAILED DESCRIPTION OF THE PREFERRED EMBODIMENTS

Now, a process cartridge according to the present invention and an electrophotographic image forming apparatus to which such a process cartridge can detachably be mounted will be fully explained with reference to the accompanying drawings.

Incidentally, in embodiments of the present invention described hereinbelow, an electrophotographic image forming apparatus in which an image is formed on an electrophotographic photosensitive member by using an electrophotographic image forming process, and a process cartridge detachably mountable to such an image forming apparatus will be illustrated and explained.

First Embodiment

Figure 2:
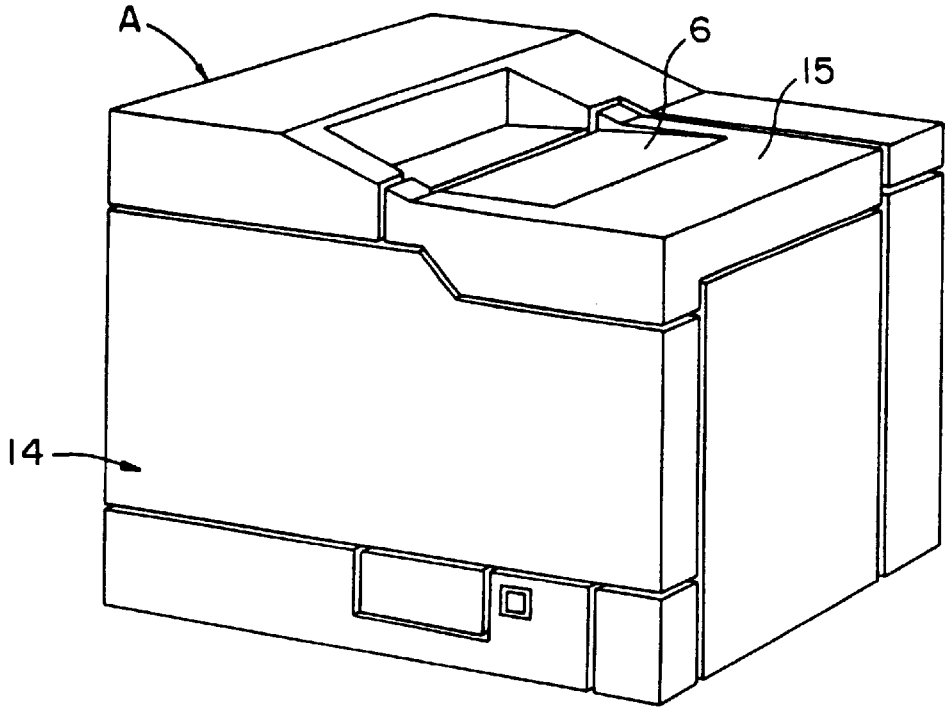
FIG. 2 is a perspective view of the electrophotographic image forming apparatus of FIG. 1.
Figure 3:
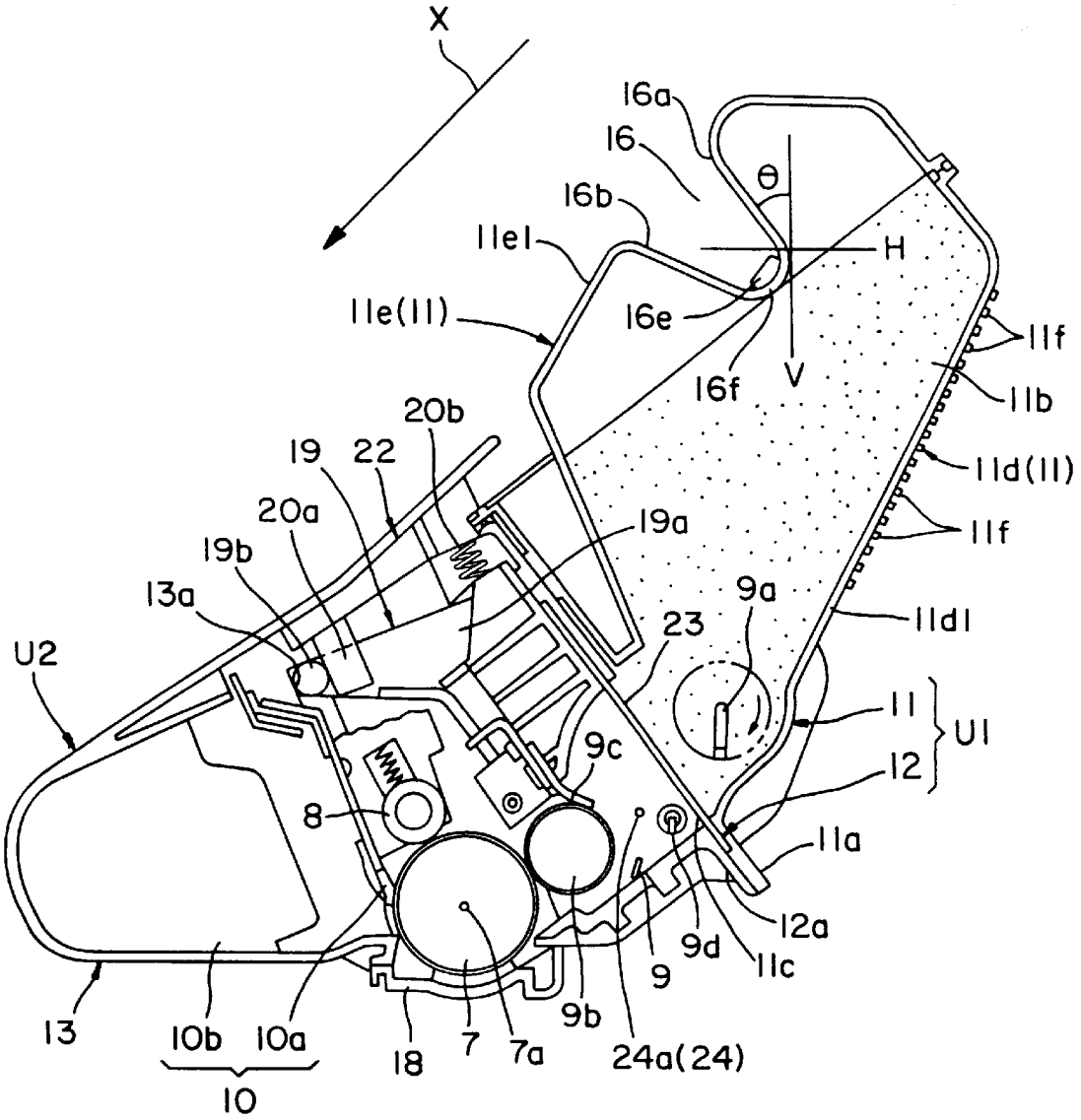
FIG. 3 is a sectional view showing a housing and an internal construction of a process cartridge used with the electrophotographic image forming apparatus of FIG. 1.

I. Schematic Construction of Electrophotographic Image Forming Apparatus:

First of all, the construction of an electrophotographic image forming apparatus (laser beam printer, in the illustrated embodiment) to which the present invention can be applied will be explained with reference to FIGS. 1 and 2. FIG. 3 shows a housing structure and an internal structure of a process cartridge.

Figure 1:
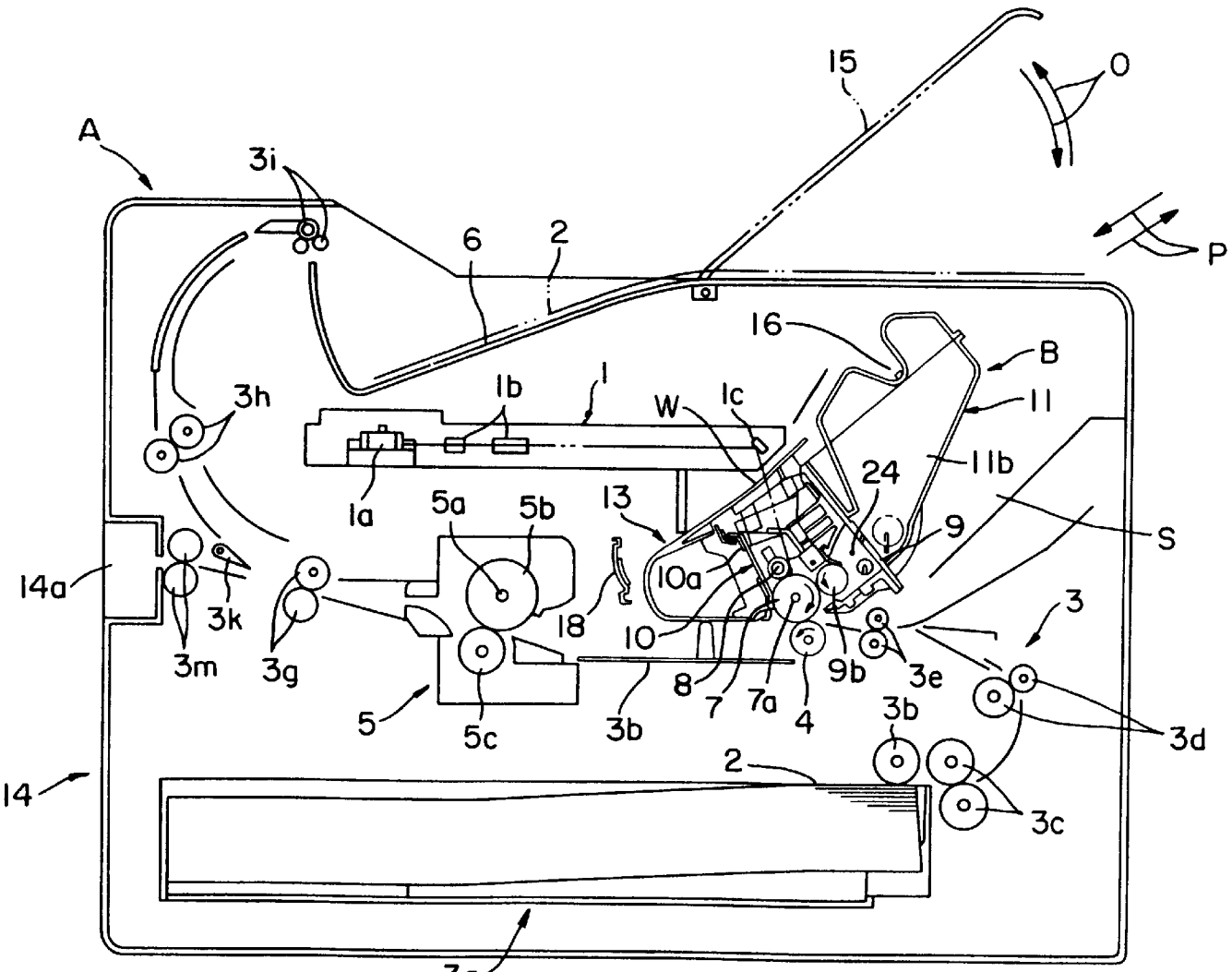
FIG. 1 is a sectional view showing an internal construction of an electrophotographic image forming apparatus according to a first embodiment of the present invention.

As shown in FIG. 1, in the electrophotographic image forming apparatus (referred to merely as "image forming apparatus" hereinafter) A, a laser beam L emitted from an optical means 1 in response to image information illuminates a drum-shaped electrophotographic photosensitive member (referred to as "photosensitive drum" hereinafter) 7 in an image forming portion of the process cartridge B to form a latent image, and then, the latent image is developed with toner as a toner image.

In synchronism with the formation of the toner image, a recording medium (for example, recording sheet) 2 supplied from a cassette 3*a* by a pick-up roller 3*b* and a pair of sheet supply rollers 3*c* is conveyed to the image forming portion by a pair of convey rollers 3*d* and a pair of regist rollers 3*e* in a reverse manner. Thereafter, the toner image formed on the photosensitive drum 7 is transferred onto the recording medium 2 by applying voltage to a transfer roller 4. Then, the recording medium 2 is sent to a fixing means 5 through a convey guide. The fixing means 5 comprises a fixing roller 5*b* including a heater 5*a* therein, and a drive roller 5*c* so that the toner image can be fixed to the recording medium 2 by applying heat and pressure to the recording medium while the recording medium is being passed between the rollers 5*b* and 5*c*.

Then, the recording medium 2 is conveyed through a reverse convey path by pairs of discharge rollers 3*g*, 3*h* and then is discharged, by a pair of discharge rollers 3*i*, onto a discharge tray 6 formed on an upper surface of a main body of the image forming apparatus (referred to as "apparatus body" hereinafter) 14.

Incidentally, in FIG. 1, the reference numeral 1*a* denotes a polygon mirror; 1*b* denotes a lens; and 1*c* denotes a reflection mirror.

As shown in FIG. 1, in the process cartridge B forming the image forming portion, a surface (photosensitive layer) of the rotating photosensitive drum 7 is uniformly charged by a charge roller (charge means) 8. Then, by illuminating the photosensitive drum with the laser beam L from the optical system 1 through an exposure opening W, the latent image is formed on the drum. Then, the latent image formed on the photosensitive drum is developed as the toner image by applying toner to the latent image by a developing roller 9*b* of a developing means 9 which will be described later.

The toner image formed on the photosensitive drum 7 is transferred onto the recording medium 2 by the transfer roller 4 of the image forming apparatus A. Thereafter, residual toner remaining on the photosensitive drum 7 is removed by a cleaning blade 10*a* of a cleaning means 10 which will be described later.

In the image forming apparatus A, a convey means 3 is constituted by the above-mentioned pick-up roller 3*b*, the pair of sheet supply rollers 3*c*, the pair of convey rollers 3*d*, the pair of regist rollers 3*e*, the convey guide, pairs of discharge rollers 3*g*, 3*h*, 3*i* and the reverse rotation convey path, as well as a pair of discharge rollers 3*m* and a flapper 3*k* which will be described later. By rotating the pairs of rollers 3*d*, 3*e*, 3*f*, 3*g*, 3*h*, 3*i* in a reverse direction, a recording medium 2 can be manually inserted from the discharge tray 6 (manual insertion sheet supply). Further, by deflecting the flapper 3*k*, the recording medium 2 from the fixing means 5 can be discharged through a discharge opening 14*a* formed in a side wall of the apparatus body 14 by the pair of discharge rollers 3*m*.

The image forming apparatus A includes a cartridge cover (opening/closing member) 15 for closing an opening of a cartridge mounting portion S defined within the apparatus body 14 (FIG. 1). The cartridge cover 15 can be opened when the process cartridge B is mounted to the apparatus body 14. As shown in FIGS. 1 and 2, the cartridge cover 15 is pivotally supported by the apparatus body 14 to form a front portion of the discharge tray 6 and can be pivoted in directions O to open and close the cartridge mounting portion S. The cartridge mounting portion S includes cartridge mounting guides G (FIG. 11A) provided on both sides of the apparatus body 14 in a width-wise direction (front-rear direction) thereof. The process cartridge B can detachably the mounted to the cartridge mounting portion S while being guided by the cartridge mounting guides G in a direction P transverse to an axis 7*a* of the photosensitive drum 7 (longitudinal direction of the photosensitive drum 7).

II. Housing Structure and Internal Structure of Process Cartridge:

As shown in FIG. 3, the process cartridge B has a housing obtained by pivotally interconnecting a developing unit U1 and a cleaning unit U2, and the housing is detachably mounted to the apparatus body 14. The developing unit U1 includes a toner frame 11 forming a frame of a toner containing portion, the developing means 9 and a developing frame 12 for supporting the developing means 9. The cleaning unit U2 includes the photosensitive drum 7, the charge means 8, the cleaning means 10, a cleaning frame 13 and a drum shutter member 18.

Next, a method for interconnecting the units U1, U2 of the process cartridge B and the internal structure of the cartridge will be fully described.

The developing unit U1 is formed by welding opposed flanges 11*e* and 12*a* of the toner frame 11 and the developing frame 12 to each other.

The toner frame 11 of the developing unit U1 has a toner containing portion 11*b* for containing the toner, and the toner containing portion 11*b* has a toner supply opening 11*c* through which the toner is supplied to a developing chamber of the developing frame 12. A seal member 23 welded around the toner supply opening 11*c* and sealing the toner supply opening 11*c* serves to prevent the toner in the toner containing portion 11*b* from leaking into the developing frame 12 before the process cartridge B is used. When the process cartridge B is used, when the operator peels the seal member 23, the toner contained in the toner containing portion 11*b* can be supplied to the developing roller 9*b*.

The developing frame 12 of the developing unit U1 supports the developing means 9 which includes a toner feed member 9*a* disposed within the toner frame 11, and a developing roller 9*b*, a developing blade 9*c*, and an agitating member 9*d* which are disposed within the developing frame 12. In the developing means, by rotating the toner feed member 9*a*, the toner in the toner frame 11 is sent to the developing roller 9*b*. While the developing roller 9*b* is being rotated, a toner layer is formed on a surface of the developing roller 9*b* by the developing blade 9*c*. The toner in the toner layer is electrically transferred to the latent image formed on the photosensitive drum 7 to develop the latent image as the toner image. By rotating the agitating member 9*d* in synchronism with the toner feed member 9*a* and the developing roller 9*b*, the toner in the developing chamber is agitated. The developing means 9 is not limited to the illustrated one, but any developing means can be used.

A toner amount detection means 24 disposed within the developing chamber of the developing frame 12 has a metallic antenna line 24*a* extending in parallel with the developing roller 9*b* and is disposed in a toner supply passage from the toner containing portion 9*a* to the developing roller 9*b* in the developing chamber. When the voltage is applied to the developing roller 9*b*, the toner amount detection means 24 detects a change in electrostatic capacity between the antenna line 24*a* and the developing roller 9*b* to thereby detect the residual amount of toner. That is to say, a phenomenon that the electrostatic capacity between the antenna line 24*a* and the developing roller 9*b* becomes smaller when there is toner between the antenna line and the developing roller and the electrostatic capacity between the antenna line 24*a* and the developing roller 9*b* becomes greater when there is no toner between the antenna line and the developing roller is utilized. In this way, the absence of toner (more specifically, the fact that the residual amount of toner reaches a predetermined value) is judged. Incidentally, the judgement of the toner amount detection is effected whenever the image forming process is performed.

The cleaning frame 13 includes the photosensitive drum 7, the charge roller 8, and the cleaning means 10 having the cleaning blade 10*a* and a waste toner reservoir 10*b*. The drum shutter member 18 disposed outside of the cleaning frame 13 serves to cover the photosensitive drum 7 to protect the latter when the process cartridge B is dismounted from the apparatus body 14. Further, the exposure opening W is formed in the cleaning frame 13. The cleaning frame 13 forms a part of the cleaning unit U2.

In this way, the process cartridge B is constituted by the developing unit U1 and the cleaning unit U2. The developing unit U1 and the cleaning unit U2 are pivotally interconnected by developing holders 19 and connection member 20 which will be described later. Now, the connection arrangement will be explained.

The developing holders 19 are disposed on both sides of the developing frame 12 of the developing unit U1 with respect to the longitudinal direction thereof (axial direction of the developing roller 9*b*) to rotatable support both ends of the developing roller 9*b*. Each developing holder 19 has an arm portion 19*a* extending toward the cleaning unit U2, and a rotary shaft 19*b* is provided on a tip end of the arm portion 19*a*. Recessed portions 13*a* for positioning and locking the rotary shafts 19*b* of the developing holders 19 are formed in both sides of the cleaning frame 13 of the cleaning unit U2 with respect to the longitudinal direction of the photosensitive drum 7. The rotary shafts 19*b* of the developing holders 19 are inserted into the recessed portions 13*a* of the cleaning frame 13 and are held by projections 20*a* of the connection members 20 fitted in the cleaning frame 13. In this condition, the projections 20*a* are secured to the cleaning frame 13 by screws. In this way, the developing unit U1 and the cleaning unit U2 are interconnected for pivotal movement around the rotary shafts 19*b* of the developing holders 19.

In this connection arrangement, although the developing roller 9*b* is biased toward the photosensitive drum 7 by the weight of the developing unit U1, the developing roller 9*b* is biased toward the photosensitive drum 7 more positively by biasing the developing frame 12 downwardly by compression springs 20*b* attached to the connection members 20. By urging spacer rings (not shown) fitted on both longitudinal end portions of the developing roller 9*b* against the photosensitive drum 7, the developing roller 9*b* are opposed to the photosensitive drum 7 with a predetermined gap therebetween.

In the housing of the process cartridge B having the above-mentioned construction, the photosensitive drum 7 is drivingly connected to the toner feed member 9*a*, the developing roller 9*b* and the agitating member 9*d* of the developing means 9 by a gear mechanism (not shown). When the process cartridge B is mounted in the cartridge mounting portion S of the apparatus body 14, a driven gear secured to a drum shaft (not shown) of the photosensitive drum 7 is engaged by a drive gear (not shown) of the apparatus body 14. Thus, when the drive gear is operated, the photosensitive drum 7, the toner feed member 9*a*, the developing roller 9*b* and the agitating member 9*d* are rotated.

A ground contact for grounding the photosensitive drum 7, a charge bias contact for the charge roller 8, a developing bias contact for the developing roller 9*b* and a toner amount detection contact connected to the antenna line 24*a* of the toner amount detection means 24 (these contacts are not shown) are provided on the housing of the process cartridge B at predetermined positions. When the process cartridge B is mounted in the cartridge mounting portion S of the apparatus body 14, these contacts are electrically connected to corresponding electrical contacts provided in the apparatus body 14.

III. Toner Frame of Process Cartridge

Next, the construction of the toner frame 11 of the process cartridge B will be fully described.

As shown in FIG. 3, the toner frame 11 is constituted by interconnecting a container body (first container portion) 11*d* and a container member (second container portion) 11*e* to each other by welding. A recess (grip portion) 16 (FIG. 4) is formed in an upper wall 11*e*1 of the container member 11*e* forming an outer wall of the toner frame 11 (toner containing portion 11*b*) through the entire dimension of the container member 11*e* along a direction substantially parallel with the axis 7*a* of the photosensitive drum 7 shown in FIG. 3 (i.e., substantially parallel with the longitudinal direction of the photosensitive drum 7). Incidentally, FIG. 3 shows a condition that the process cartridge B is mounted to the apparatus body 14. Accordingly, when the process cartridge B is mounted, the upper wall 11*e*1 defines an upper surface of the cartridge. The portion in which the recess is formed is included in the outer wall of the toner containing portion 11*b*.

Incidentally, in the illustrated embodiment, the amount of toner contained in the toner containing portion 11*b* can be selected appropriately. Further, in the illustrated embodiment, the weight of the process cartridge is about 3 to 4 kg and the volume of the toner containing portion 11*b* is about 2000 cc.

IV. Construction of Recess as Grip Portion

The recess 16 as the grip portion is formed at a position where the operator can grip the recess together with an inclined bottom wall 11*d*1 (FIG. 3) of the container body 11*d*. A plurality of locking ribs 11*f* engaged by the operator's fingers are formed on the inclined bottom wall 11*d*1 of the container body 11*d* in parallel with the recess 16.

As shown in FIG. 3, the recess 16 has an inner wall portion remote from the cleaning frame 13, which inner wall portion is formed as an inclined wall 16*a* inclined at an angle θ permitting the free dropping of the toner (by its own weight) (more specifically, the angle θ is smaller than 30 degrees with respect to a vertical line V, i.e., greater than 60 degrees with respect to a horizontal line H). With this arrangement, the toner can freely be dropped on the inclined bottom wall 11*d*1 of the container body 11*d* to prevent the toner from being trapped at the recess 16 to thereby permit the complete consumption of toner in the toner container portion 11*b*.

Figure 4:
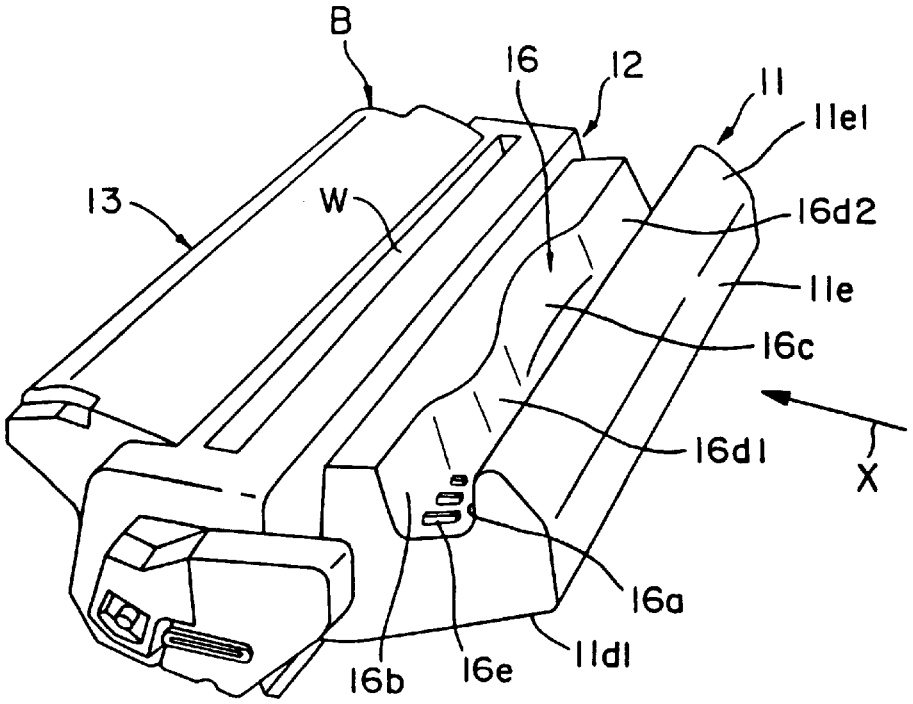
FIG. 4 is a perspective view of the process cartridge.

As shown in FIG. 4, the recess 16 has an inner wall portion 16*b* near the cleaning frame 13, which inner wall portion has an undulation surface. In the longitudinal direction of the recess 16, one side guide portion 16*d*1 including a central portion 16*c* and slip preventing ribs 16*e* is wider than the other side guide portion 16*d*2.

Further, as shown in FIG. 4, the plurality of slip preventing protruded ribs (slip preventing means) 16*e* are formed on an inner bottom wall 16*f* of the one side guide portion of the recess 16 at a predetermined interval. The slip preventing ribs 16*e* each have a round tip end for facilitating the engagement of the operator's fingers with the ribs. As another example of the slip preventing means, for example, an indentation may be formed on the inclined wall 16*a* or the inner bottom wall 16*f* partially or entirely.

V. Mounting of Process Cartridge to Apparatus Body

After the cartridge cover 15 of the apparatus body 14 is opened, the process cartridge B having the above-mentioned construction is mounted in the cartridge mounting portion S of the apparatus body 14 in the following manner.

Figure 5:
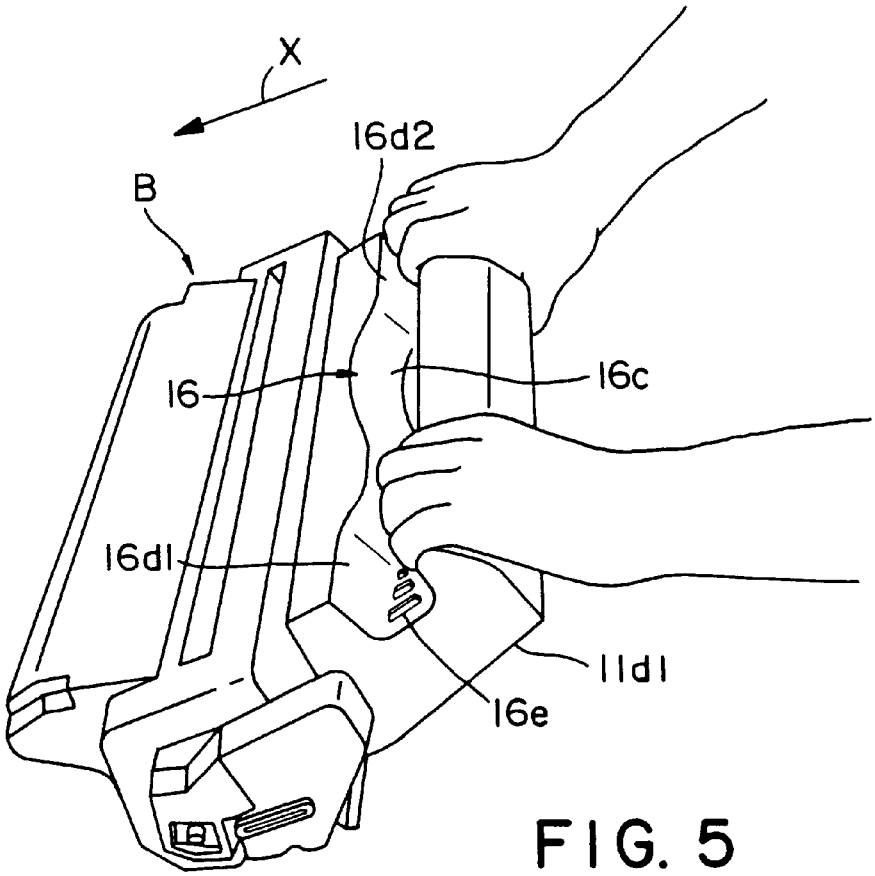
FIG. 5 is an explanatory view showing an example that the process cartridge is gripped by both hands of an operator.

First of all, a case where the process cartridge B is mounted in the cartridge mounting portion S from a front side thereof will be explained. In this case, for example, as shown in FIG. 5, the process cartridge B is held by the operator gripping the both side guide portions of the recess 16 and the inclined bottom wall 11*d*1 of the container body 11*d* by his both hands in a normal manner. In this condition, the process cartridge B is inserted and mounted in the cartridge mounting portion S of the apparatus body 14.

Figure 6:
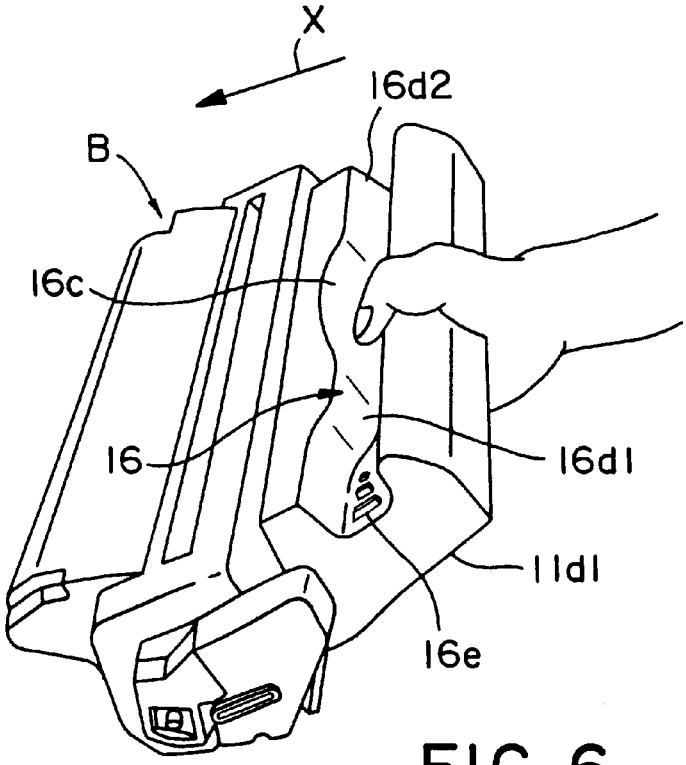
FIG. 6 is an explanatory view showing an example that the process cartridge is gripped by a single hand of an operator.

In this case, the operator can sometimes utilize only a single hand to grip the process cartridge for some reasons. In such a case, as shown in FIG. 6, the process cartridge B is held by the operator gripping the central portion 16*c* and the inclined bottom wall 11*d*1 of the container body 11*d* by his single hand. In this condition, the process cartridge B is inserted and mounted in the cartridge mounting portion S of the apparatus body 14. In this case, since the process cartridge B is held by gripping the central portion 16*c* of the recess 16 (grip portion) by the operator's single hand, the weight of the process cartridge B can easily be balanced, and thus, the mounting and dismounting of the process cartridge B can be facilitated even when the single hand is used.

Figure 7:
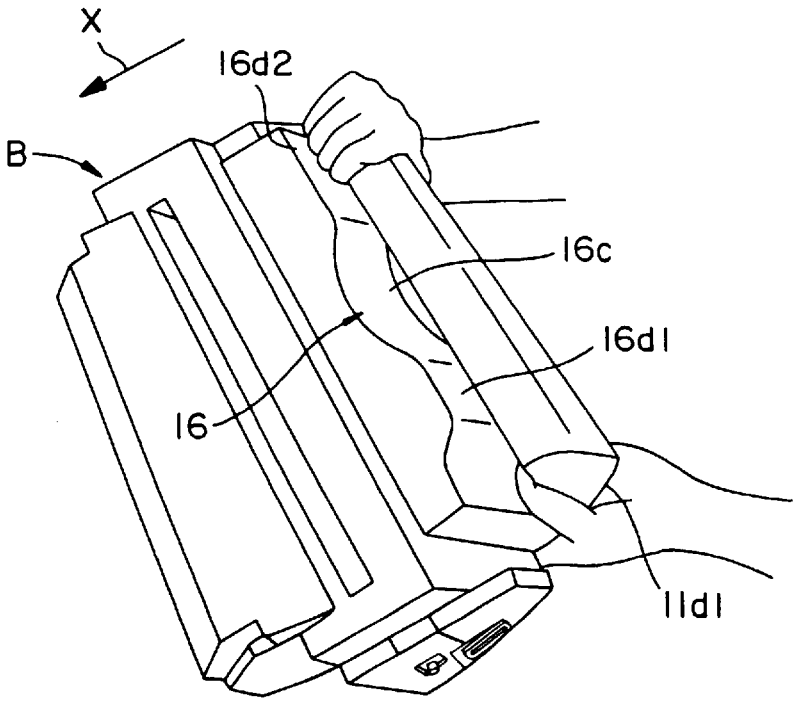
FIG. 7 is an explanatory view showing another example that the process cartridge is gripped by both hands of an operator.

To hold the process cartridge B by utilizing the slip preventing ribs 16*e*, as shown in FIG. 7, the process cartridge B is held by the operator gripping the other side guide portion of the recess 16 (grip portion) and the inclined bottom wall, 11*d*1 of the container body 11*d* by his right hand in a normal manner and gripping the inclined bottom wall 11*d*1 of the container body 11*d* by his left hand with the thumb hooked to the slip preventing ribs 16*e* (nor seen). In this condition, the process cartridge B is inserted and mounted in the cartridge mounting portion S of the apparatus body 14. By hooking the thumb to the slip preventing ribs 16*e* in this way, the thumb can be prevented from slipping from the process cartridge B.

Figure 8:
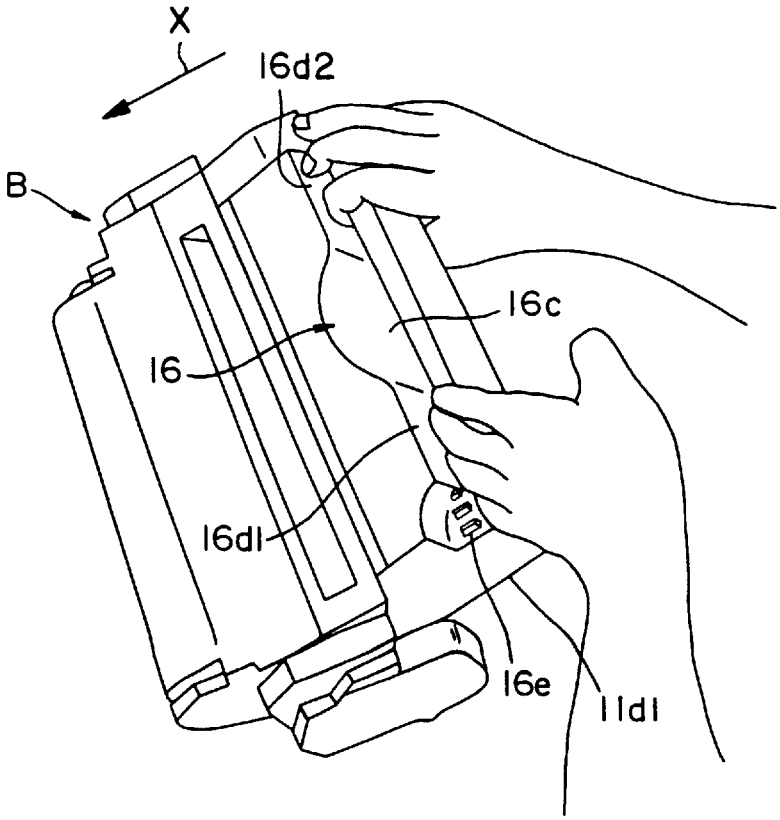
FIG. 8 is an explanatory view showing a further example that the process cartridge is gripped by both hands of an operator.

Next, a case where the process cartridge B is mounted in the cartridge mounting portion S from a lateral side thereof will be explained. In this case, for example, as shown in FIG. 8, the process cartridge B is held by the operator gripping both side guide portions of the recess 16 and the inclined bottom wall 11*d*1 of the container body 11*d* by his both hands in a normal manner. In this condition, the process cartridge B is inserted and mounted in the cartridge mounting portion S of the apparatus body 14.

In this case, similar to FIG. 6, the process cartridge B can be held by the operator gripping the central portion 16*c* and the inclined bottom wall 11*d*1 of the container body 11*d* by his single hand, and, in this condition, the process cartridge B can be inserted and mounted in the cartridge mounting portion S of the apparatus body 14.

In the mounting operation of the process cartridge B, even if the operator erroneously drops the process cartridge B on the floor, since the slip preventing ribs 16*e* are formed in the inner surface of the recess 16, they are not damaged.

In the process cartridge B according to the illustrated embodiment, as mentioned above, both side guide portions of the recess 16 and the inclined bottom wall 11*d*1 of the container body lid can be gripped by the operator's both hands or the central portion 16*c* and the inclined bottom wall 11*d*1 of the container body 11*d* can be gripped by the operator's single hand. Thus, the operator can select the optimum gripping position so that the process cartridge B can be mounted and dismounted with respect to the apparatus body 14 most easily, in accordance with the installation position of the image forming apparatus A. In this way, by holding the process cartridge B in a dismount permitting condition or an insertion permitting condition, the process cartridge can easily be aligned with the cartridge mounting portion S.

In the process cartridge B according to the illustrated embodiment, the mounting/dismounting operation of the large process cartridge B having large capacity with respect to the apparatus body 14 can easily be performed regardless of the installation position of the image forming apparatus A.

Second Embodiment

Next, an image forming apparatus according to a second embodiment of the present invention will be explained with reference to FIGS. 9, 10A and 10B, 11A and 11B.

As is in the first embodiment, a laser beam printer is illustrated as the image forming apparatus.

Figure 9:
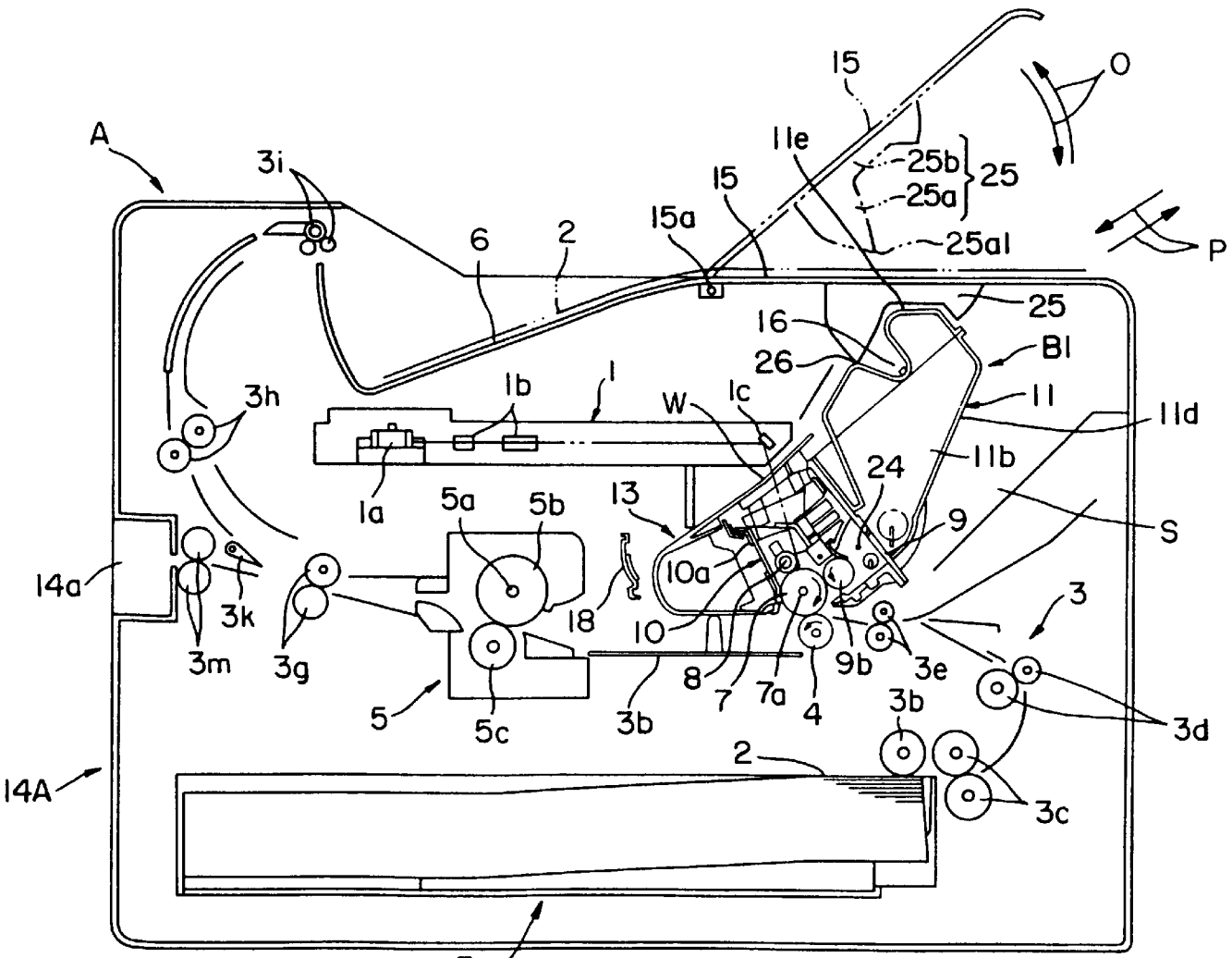
FIG. 9 is a sectional view showing an internal construction of an electrophotographic image forming apparatus according to a second embodiment of the present invention.
Figure 10A:
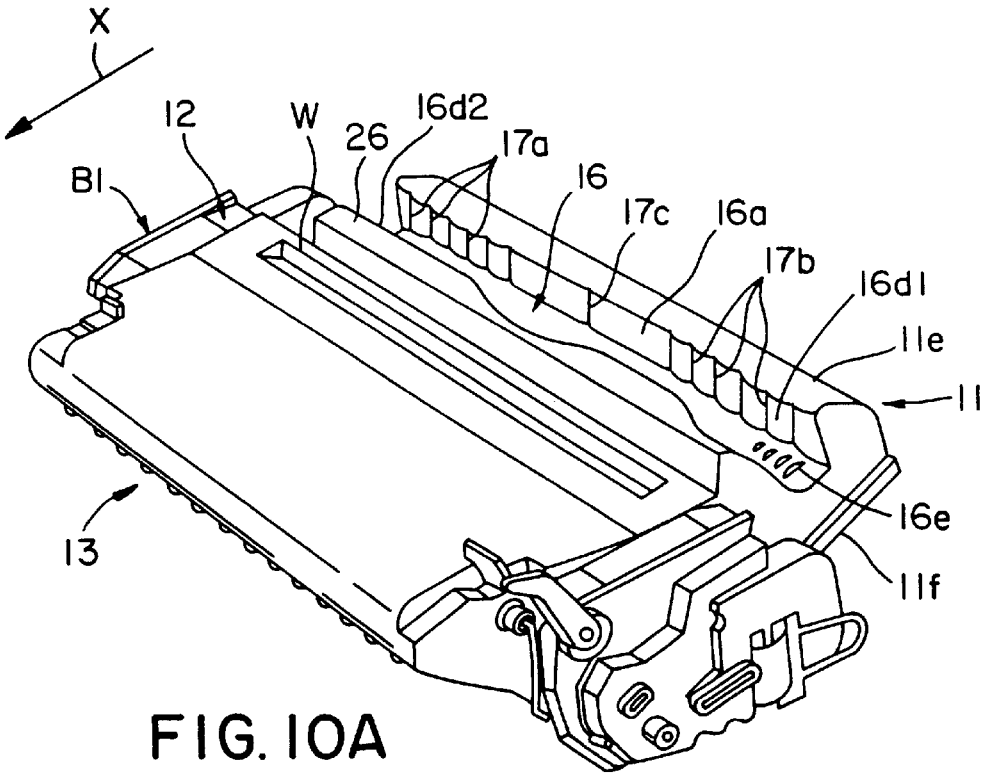
FIGS. 10A and 10B are perspective views of a process cartridge used with the electrophotographic image forming apparatus of FIG. 9.
Figure 10B:
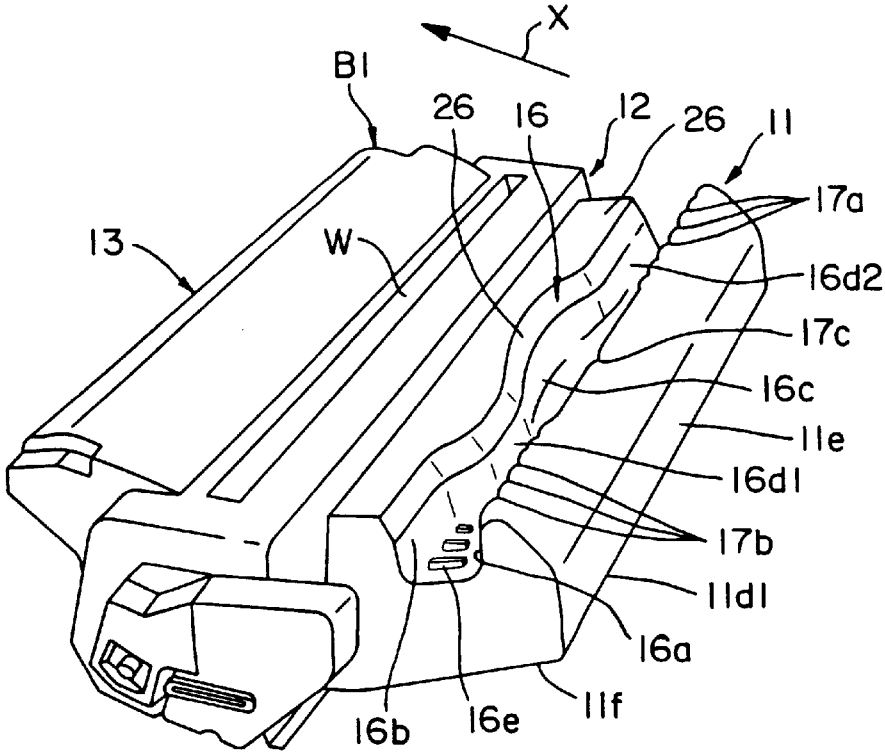
Figure 11A:
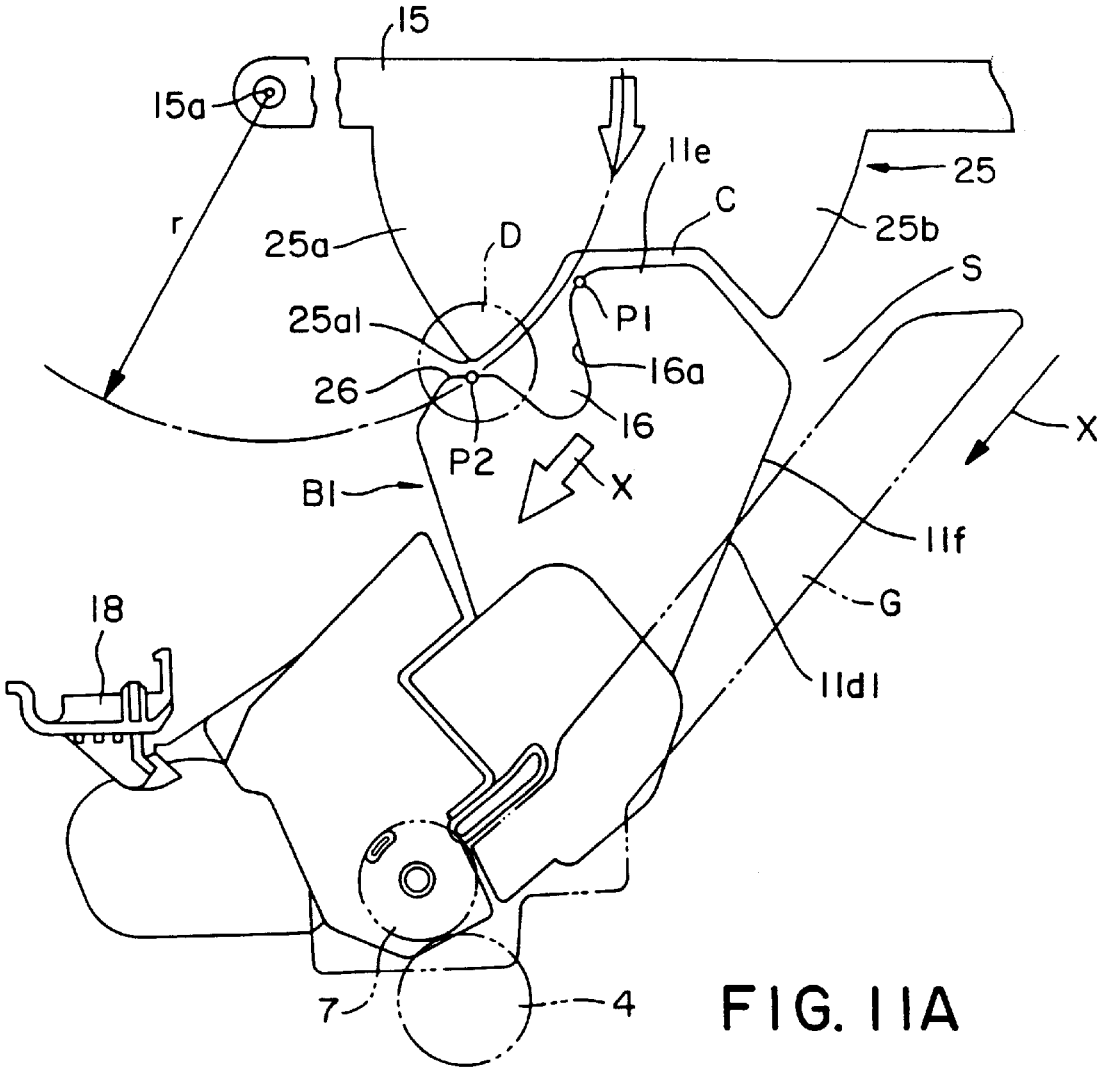
FIG. 11A is an explanatory view showing the positional relation between a cartridge cover and the process cartridge in a closed condition.
Figure 11B:
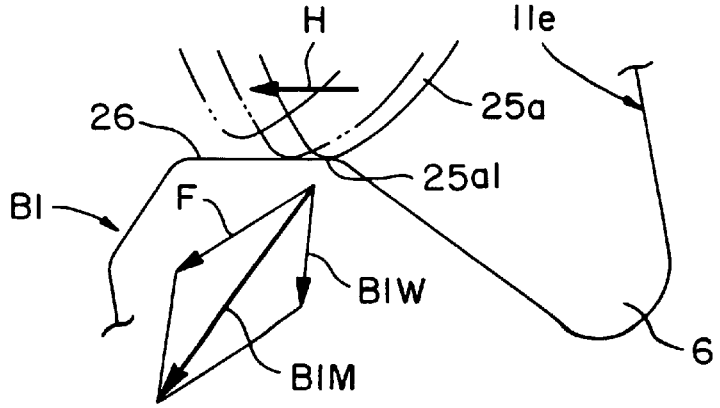
FIG. 11B is an enlarged view of a portion in a circle D in FIG. 11A, showing a condition that a pressure receiving portion of the process cartridge is urged by an urging portion of a process cartridge urging means of a cartridge cover.

FIG. 9 is a schematic sectional view showing the internal structure of the image forming apparatus, FIGS. 10A and 10B are perspective views of a process cartridge, and FIGS. 11A and 11B are views showing the positional relation between a cartridge cover of an apparatus body and the process cartridge mounted in a cartridge mounting portion of the apparatus body.

As shown in FIG. 9, in the apparatus body 14A according to the second embodiment, a process cartridge urging means 25 is provided on a rear surface of a cartridge cover (opening/closing member) 15 similar to that of the first embodiment. The other constructions of the apparatus body 14A are the same as those of the apparatus body 14 of the first embodiment.

In the process cartridge B1 according to this embodiment, as shown in FIGS. 10A and 10B, a toner frame 11 similar to that of the process cartridge B of the first embodiment is provided with an auxiliary recess 17 corresponding to the operator's fingers and a pressure receiving portion 26 for receiving an urging element 25*a* of the process cartridge urging means 25. Further, as shown in FIG. 11A, the configuration of the recess 16 of the process cartridge is determined on the basis B a radius of rotation of the cartridge cover of the apparatus body 14A. The other construction of the process cartridge are the same as those of the process cartridge B of the first embodiment.

Thus, the same elements of the process cartridge and the apparatus body as those in the first embodiment are designated by the same reference numerals and an explanation thereof will be omitted.

I. Process Cartridge Urging Means of Apparatus Body

As shown in FIG. 9, the apparatus body 14A has the process cartridge urging means (referred to merely as "urging means" hereinafter) 25 provided on the rear surface of the cartridge cover 15 of the apparatus body 14A. The urging means 25 comprises the urging element 25*a* for urging the pressure receiving portion 26 of the process cartridge B1 mounted to the apparatus body 14A when the cartridge cover 15 is closed, and a position setting portion 25*b* for covering, with a predetermined clearance, the toner frame 11 of the process cartridge B1 mounted to the apparatus body 14*a* when the cartridge mounting portion S is closed by the cartridge cover 15.

The urging element 25*a* of the urging means 25 has an urging portion 25*a*1 for abutting against the pressure receiving portion 26 of the process cartridge B1 to urge the process cartridge B1, which urging portion is situated at a position spaced apart from a rotation center 15*a* of the cartridge cover 15 by a distance (radius) r. The position setting portion 25*b* is configured to cover the toner frame 11 of the process cartridge B1 from an upper wall portion 11*e*1 of the container member 11*e* to a welded portion (between the container body 11*d* and the container member 11*e*).

II. Auxiliary Recess of Process Cartridge Corresponding to Operator's Fingers:

In the process cartridge B1 according to the second embodiment, as shown in FIG. 10A, the toner frame (toner containing portion) 11 is provided with the auxiliary recess 17 corresponding to the operator's fingers. The auxiliary recess 17 corresponding to the operator's fingers is formed in the container member 11*e* of the toner frame 11 (toner containing portion 11*b*) having the recess 16. More specifically, first and second auxiliary recessed portions 17*a* and 17*b* are provided on both sides of a surface (grip surface) of an inclined wall 16*a* of the recess 16 along the longitudinal a direction thereof (direction substantially parallel to the longitudinal direction of the photosensitive drum 7), and a third auxiliary recessed portion 17*c* is positioned between the first and second auxiliary recessed portions 17*a* and 17*b*.

The first recessed portion 17*a* is constituted by a plurality (six in this case) of parallel recesses corresponding to fingers of the right hand of the operator. The recesses of the first recessed portion 17*a* extend from an upper edge of the inclined wall 16*a* to the inner bottom wall 16*f* so that they can be hooked by all fingers of the right hand of the operator in a direction perpendicular to the longitudinal direction of the recess 16.

The second recessed portion 17*b* is constituted by a plurality (six in this case) of parallel recesses corresponding to fingers of the left hand of the operator. The recesses of the first recessed portion 17*b* extend from an upper edge of the inclined wall 16*a* to the inner bottom wall 16*f* so that they can be hooked by all fingers of the left hand of the operator in the direction perpendicular to the longitudinal direction of the recess 16.

The third recessed portion 17*c* is constituted by a single recess corresponding to any single finger of the left or right hand of the operator. The recess extends from an upper edge of the inclined wall 16*a* to the inner bottom wall 16*f* to be hooked by any single finger of the left or right hand of the operator in the direction perpendicular to the longitudinal direction of the recess 16.

III. Pressure Receiving Portion of Process Cartridge

In the process cartridge B1 according to the second embodiment, as shown in FIG. 10B, the toner frame 11 (toner containing portion) has the pressure receiving portion 26 for receiving the urging element 25*a* of the urging means 25. The pressure receiving portion 26 is provided on the container member 11*e* of the toner frame 11 (toner containing portion 11*b*) having the recess 16. More specifically, the pressure receiving portion is formed on the undulation inner wall 16*b* opposed to the inclined wall 16*a* of the recess (grip portion) 16 at a position spaced apart from the rotation center 15*a* of the cartridge cover 15 by a distance (radius) r (in the illustrated embodiment, the pressure receiving portion is formed on an upper edge portion of the undulation inner wall 16*b*). Similar to the recess 16, the pressure receiving portion 26 extends along the entire dimension of the container member 11*e* in a direction substantially parallel to the axis 7*a* of the photosensitive drum 7 (direction substantially parallel to the longitudinal direction of the photosensitive drum 7). The pressure receiving portion provides a horizontal surface when the process cartridge B1 is mounted in the cartridge mounting portion S of the apparatus body 14A. When the cartridge cover 15 of the apparatus body 14A is closed, the urging element 25*a* of the urging means 25 abuts against the pressure receiving portion 26.

IV. Recess (Grip Portion) of Process Cartridge

As shown in FIG. 11A, the configuration of the recess 16 of the toner frame 11 of the process cartridge B1 is determined so that a uniform and minimum clearance C is provided between the cartridge cover 15 of the apparatus body 14A and the portion of the process cartridge B1 near the recess 16 under a condition that the process cartridge B1 is mounted in the cartridge mounting portion S of the apparatus body 14A.

More specifically, points for determining the configuration (width configuration) of the recess 16 provided in the toner frame 11 of the process cartridge B1 are set to a point P1 disposed on the upper edge portion of the inclined wall 16*a* and spaced apart from the rotation center 15*a* of the cartridge cover 15 of the apparatus body 14A by the radius r, and a point P2 corresponding to substantially a center of the pressure receiving portion 26. On the basis of the points P1, P2 determined in this way, the width configuration of the recess 16 is determined. Thus, when the process cartridge B1 is mounted to the apparatus body 14A, the clearance C between the apparatus body 14A and the process cartridge B1 becomes substantially uniform through the entire area above the container body 11*e* of the toner frame 11 (i.e., the entire area in the direction parallel to the axis 7*a* of the photosensitive drum 7), except the recessed portions 17*a,* 17*b* and 17*c* corresponding to the operator's fingers. Incidentally, in FIG. 11A, the symbol G denotes the cartridge mounting guide of the cartridge mounting portion S.

V. Mounting of Process Cartridge to Apparatus Body

After the cartridge cover 15 of the apparatus body 14A is opened, the process cartridge B1 having the above-mentioned construction is mounted to the cartridge mounting portion S of the apparatus body 14A in the following manner.

Figure 12:
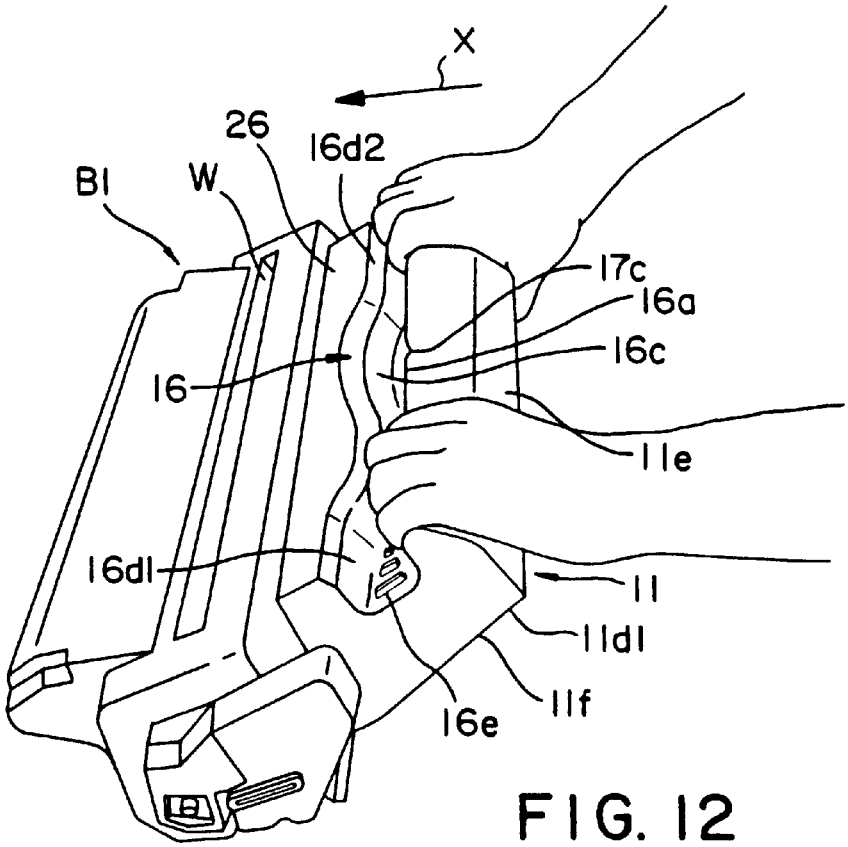
FIG. 12 is an explanatory view showing an example that the process cartridge of FIGS. 10A and 10B is gripped by both hands of an operator.

First of all, a case where the process cartridge B1 is mounted in the cartridge mounting portion S from a front side thereof will be explained. In this case, for example, as shown in FIG. 12, the process cartridge B1 is held by the operator gripping both side guide portions of the recess 16 and the inclined bottom wall 16*d*1 of the container body 11*d* by both hands in a normal manner. In this case, the process cartridge B1 is held by hooking the index fingers, the middle fingers, the third fingers and the little fingers of the right and left hands of the operator on the first and second recessed portions 17*a,* 17*b* formed in the inclined wall 16*a*. In this condition, the process cartridge B1 is inserted and mounted in the cartridge mounting portion S of the apparatus body 14A.

Figure 13:
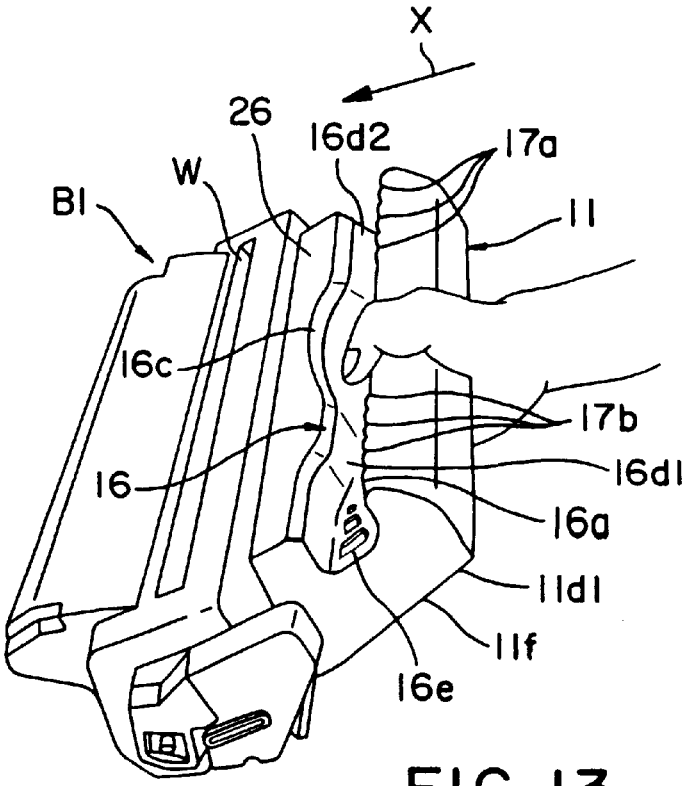
FIG. 13 is an explanatory view showing an example that the process cartridge of FIGS. 10A and 10B is gripped by a single hand of an operator.

In this case, the operator can sometimes utilize only a single hand to grip the process cartridge for some reasons. In such a case, as shown in FIG. 13, the process cartridge B1 is held by the operator gripping the central portion 16*c* of the recess 16 and the inclined bottom wall 16*d*1 of the container body 11*d* by a single hand (right hand). In this case, the process cartridge B1 is held by hooking the thumb of the right hand of the operator on the third recessed portion 17*c* provided on the inclined wall 16*a* of the recess 16. In this condition, the process cartridge B1 is inserted and mounted in the cartridge mounting portion S of the apparatus body 14A. In this case, since the process cartridge B1 is held by gripping the central portion 16*c* of the recess 16 by the operator's single hand, the weight of the process cartridge B1 can easily be balanced, and, thus, the mounting and dismounting of the process cartridge B1 can be facilitated even when the single hand is used.

Figure 14:
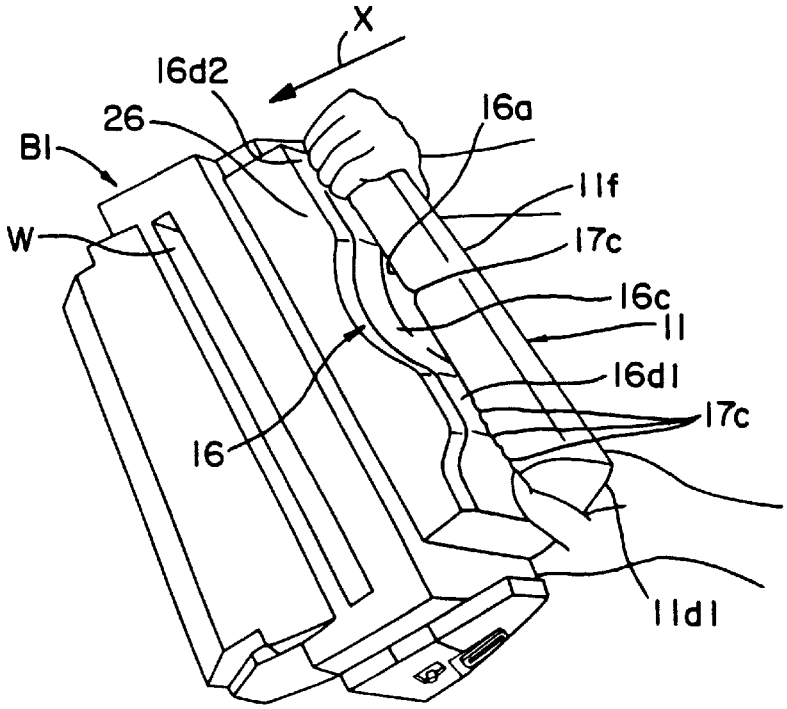
FIG. 14 is an explanatory view showing another example that the process cartridge of FIGS. 10A and 10B is gripped by both hands of an operator.

To hold the process cartridge B1 by utilizing the slip preventing ribs 16*e,* as shown in FIG. 14, the process cartridge B1 is held by the operator gripping the other side guide portion of the recess 16 and the inclined bottom wall 11*d*1 of the container body 11*d* by his right hand in a normal manner and gripping the inclined bottom wall 11*d*1 of the container body 11*d* by his left hand with the thumb hooked on the slip preventing ribs 16*e* (not seen). In this case, the process cartridge B1 is held by hooking the index finger, the middle finger, the third finger and the little finger of the right hand of the operator on the first recessed portions 17*a* formed in the inclined wall 16*a*. In this condition, the process cartridge B1 is inserted and mounted in the cartridge mounting portion S of the apparatus body 14A. By hooking the thumb of the right hand on the slit preventing ribs 16*e* in this way, the thumb can be prevented from slipping from the process cartridge B1.

Figure 15:
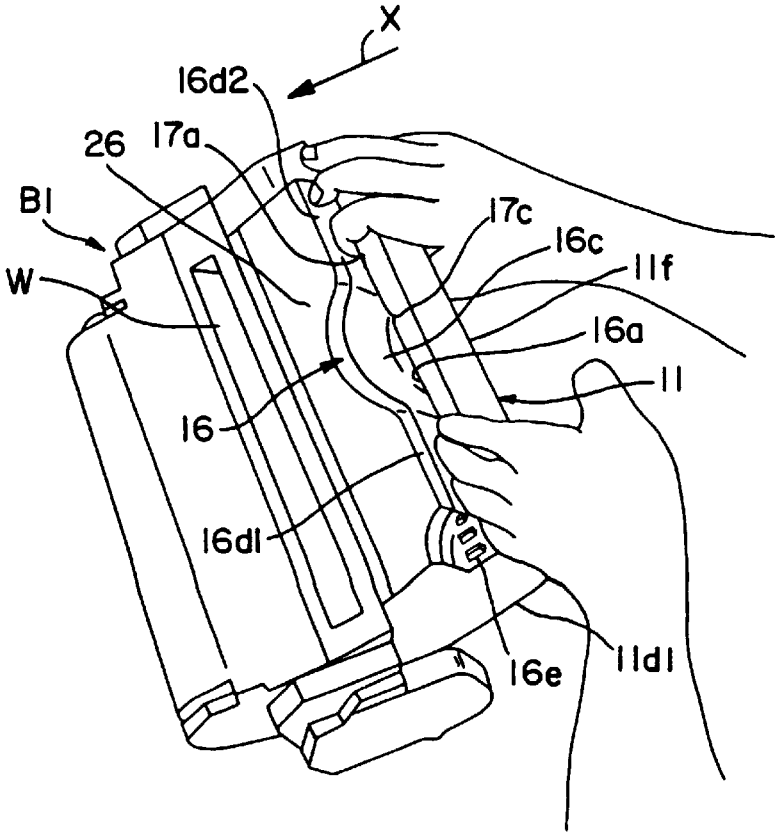
FIG. 15 is an explanatory view showing a further example that the process cartridge of FIGS. 10A and 10B is gripped by both hands of an operator.

Next, a case where the process cartridge B1 is mounted in the cartridge mounting portion S from a lateral side thereof will be explained. In this case, for example, as shown in FIG. 15, the process cartridge B1 is held by the operator gripping the both side guide portions of the recess 16 and the inclined bottom wall 11*d*1 of the container body 11*d* by his both hands in a normal manner. In this case, the process cartridge B1 is held by hooking the index finger, the middle finger and the third finger of the right hand of the operator on the first recessed portions 17*a* formed in the inclined wall 16*a* and by hooking the index finger, the middle finger, the third finger and the little finger of the left hand on the second recessed portions 17*b* formed in the inclined wall 16*a*. In this condition, the process cartridge B1 is inserted and mounted in the cartridge mounting portion S of the apparatus body 14A.

In this case, similar to FIG. 13, the process cartridge B1 can be held by the operator gripping the central portion 16*c* and the inclined bottom wall 11*d*1 of the container body 11*d* by his right hand. In this case, the process cartridge B1 is held by hooking the thumb of the right hand on the third recessed portion 17*c* formed on the inclined wall 16*a* of the recess 16. In this condition, the process cartridge B1 can be inserted and mounted in the cartridge mounting portion S of the apparatus body 14*a*.

In the process cartridge B1 according to the illustrated embodiment, as mentioned above, both side guide portions of the recess 16 and the inclined bottom wall 11*d*1 of the container body lid can be gripped by the operator's both hands or the central portion 16*c* and the inclined bottom wall 11*d*1 of the container body 11*d* can be gripped by the operator's single hand. In this case, the third recessed portion 17*c* formed on the inclined wall 16*a* of the recess 16 can be gripped by the operator's finger.

Thus, the operator can select the optimum gripping position so that the process cartridge B1 can be mounted and dismounted with respect to the apparatus body 14A most easily, in accordance with the installation position of the image forming apparatus A. In this way, by holding the process cartridge B1 in a dismount permitting condition or an insertion permitting condition, the process cartridge can easily be aligned with the cartridge mounting portion S.

In the process cartridge B1 according to the illustrated embodiment, the mounting/dismounting operation of the large process cartridge B1 having a large capacity with respect to the apparatus body 14A can easily be performed regardless of the installation position of the image forming apparatus A.

VI. Position Setting of Process Cartridge

When the cartridge cover 15 of the apparatus body 14A is closed, the process cartridge B1 mounted in the cartridge mounting portion S of the apparatus body 14A is set to the proper position of the cartridge mounting portion S of the apparatus body 14A. The position setting of such a process cartridge B1 will be explained with reference to FIGS. 11A and 11B.

When the cartridge cover 15 of the apparatus body 14A is closed from the open position shown by the two dot and chain lines in FIG. 9 to the closed position shown by the solid line (refer to FIG. 11A), as shown in FIG. 11B, the urging portion 25*a*1 of the urging means 25 of the cartridge cover 15 abuts against the pressure receiving portion 26 of the process cartridge B1, thereby urging the process cartridge B1. In this case, as shown in FIG. 11B, a movement B1M of the process cartridge B1 from the urging portion 25*a*1 of the urging means 25 and the weight B1W of the process cartridge B1 itself can be represented by a vector directed in substantially the same direction as the inserting direction X (refer to FIG. 11A) of the process cartridge B1. In this case, the movement (relative movement) of the cartridge cover 15 relative to the pressure receiving portion 26 of the process cartridge B1 is effected along a direction H and can be represented by a vector directed in parallel to the surface of the pressure receiving portion 26.

Accordingly, if the process cartridge B1 is not positioned at the proper position (where the surface of the pressure receiving portion 26 of the process cartridge B1 is maintained in the horizontal condition), the process cartridge B1 can be urged up to the proper position by the urging means of the cartridge cover 15.

As mentioned above, in the process cartridge B1 according to the illustrated embodiment, since the width-wise configuration of the recess 16 formed in the toner frame 11 is determined on the basis of the point P1 disposed on the upper edge portion of the inclined wall 16*a* and spaced apart from the rotation center 15*a* of the cartridge cover 15 of the apparatus body 14A by the radius r and the point P2 substantially corresponding to the center of the pressure receiving portion 26, the clearance C between the cartridge cover 15 of the apparatus body 14A and the container body 11*e* of the toner frame 11 can be maintained uniformly.

Further, since the flat pressure receiving portion is formed on a part of the inner wall 16*b* of the recess 16, even when the process cartridge B1 is slightly deviated from the proper position in the apparatus body 14A, the process cartridge B1 can be positioned at the proper position by urging the urging element 25*a* of the urging means 25 of the cartridge cover 15 against the pressure receiving portion 26 of the process cartridge B1.

In addition, since the container body 11*e* of the toner frame 11 is covered by a cover portion 25*b* of the urging means 25 of the cartridge cover 15 with a predetermined clearance therebetween, only by closing the cartridge cover 15, the urging element 25*a* of the urging means 25 of the cartridge cover 15 can abut against the pressure receiving portion 26 of the process cartridge B1 to thereby surely set the process cartridge B1 at the predetermined mounting position.

As mentioned above, the process cartridge B1 according to the illustrated embodiment comprises an electrophotographic photosensitive drum 7, a developing roller 9*b* for developing a latent image formed on the electrophotographic photosensitive drum 7 with toner and for supplying the toner to the electrophotographic photosensitive drum by rotation of the developing roller, a charge member (charge roller 8 in the illustrated embodiment) for charging the electrophotographic photosensitive drum 7, a cleaning member (cleaning blade 10*a* in the illustrated embodiment) for removing residual toner remaining on the electrophotographic photosensitive drum 7, a toner containing portion 9*a* for containing the toner used by the developing roller 9*b*, a recess 16 through which the process cartridge B can be gripped and which is formed in an outer surface of the toner containing portion through an entire dimension thereof substantially in parallel with an axis of the electrophotographic photosensitive drum 7, the recess 16 having a central portion wider than both longitudinal end portions, a plurality of ribs 11*f* to prevent an operator's fingers from slipping on the process cartridge when the process cartridge is gripped by the operator and formed on an outer surface (inclined bottom wall 16*d*1 in the illustrated embodiment) of the toner containing portion 9*a* which becomes a lower surface when the process cartridge is mounted and dismounted with respect to the apparatus body of an image forming apparatus and disposed side-by-side substantially in parallel with a longitudinal direction of the recess 16, and a plurality of auxiliary recessed portions 17*a*, 17*b* and 17*c* on which the operator's fingers are positioned when the process cartridge B is gripped by the operator and which are formed on an inclined wall 16*a* of the recess 16 disposed at an upstream side in a mounting direction (shown by the arrow X) of the process cartridge to the apparatus body and which are disposed side-by-side in a direction transverse to the longitudinal direction of the recess 16. Wherein the process cartridge B is mounted and dismounted with respect to the apparatus body from a direction transverse to the axis of the electrophotographic photosensitive drum 7, and there is provided a force receiving portion 26 for receiving a force for moving the process cartridge B to a predetermined mounting position if the process cartridge is mounted to the apparatus body with deviation from the predetermined mounting position, the force receiving portion 25 being disposed at a downstream side of the recess 16 in the mounting direction of the process cartridge B to the apparatus body and being capable of abutting against an inner surface of an opening/closing member 15 of the apparatus body when the opening/closing member 15 is closed. Further the process cartridge can be gripped by hooking the operator's fingers on the recess 16 and the ribs 11*f*.

Further, slip preventing projections (slip preventing ribs 16*e* in the illustrated embodiment) for preventing the operator's fingers from slipping on the process cartridge when the process cartridge is gripped by the operator may be provided on a bottom of one longitudinal end portion of the recess 16. The force receiving portion 26 is formed, contiguous to the recess 16, on a surface which becomes an upper surface when the process cartridge B is mounted to the apparatus body.

A protruded portion (urging element 25*a* in the illustrated embodiment) may be provided on the inner surface of the opening/closing member 15. If the process cartridge B is mounted to the apparatus body with a deviation from the predetermined mounting position, the protruded portion abuts against the force receiving portion 26 as the opening/closing member 15 is closed, thereby shifting the process cartridge B to the predetermined mounting position.

In the process cartridges according to the first and second embodiments, as mentioned above, the inclination angle θ of the inclined wall 16*a* of the recess (grip portion) 16 was selected to be smaller than 30 degrees with respect to the vertical line V (greater than 60 degrees with respect to the horizontal line H). With this arrangement, in the condition that the process cartridge B is mounted to the cartridge mounting portion S of the apparatus body 14, the toner can be dropped from the inclined wall 16*a* of the recess 16 by its own weight. Each slip preventing rib 16*e* was selected to have a thickness of about 1 mm and a height of about 1 to 3 mm and distance between these ribs was selected to about 3 mm. Further, each locking rib 11*f* was selected to have a thickness of about 1 mm and a height of about 1 mm and distance between these ribs was selected to about 3 mm.

In the illustrated embodiments, while the laser beam printer was explained as the image forming apparatus for forming the image on the electrophotographic photosensitive drum by utilizing the electrophotographic image forming process, the present invention is not limited to the illustrated embodiments, but may be applied to other electrophotographic image forming apparatuses such as an electrophotographic copying machine, an electrophotographic printer (for example, LED printer), an electrophotographic facsimile, an electrophotographic word processor and the like.

Further, in the Illustrated embodiments, while an example that the process cartridge B incorporates therein the charge means 8, developing means 9, 12, cleaning means 10 and electrophotographic photosensitive drum as a cartridge unit, which can detachably be mounted to the apparatus body 14 was explained, the present invention is not limited to the illustrated embodiments. For example, the present invention can be applied to a process cartridge incorporating an electrophotographic photosensitive member and at least a developing means as a cartridge unit, which can detachably be mounted to an apparatus body or a process cartridge incorporating an electrophotographic photosensitive member and at least one of a charge means and a cleaning means, as well as a developing means as a cartridge unit, which can detachably mounted to an apparatus body.

As mentioned above, according to the illustrated embodiments, since the recess is formed on the outer surface of the toner containing portion through the entire dimension thereof in parallel with the axis of the electrophotographic photosensitive member, when the operator handles the process cartridge, the operator can select the gripping position of the process cartridge optimum for the easy mounting and dismounting of the process cartridge with respect to the apparatus body in dependence upon the installation position of the image forming apparatus. Thus, a large process cartridge having large capacity can easily be mounted and dismounted with respect to the apparatus body, regardless of the installation position of the image forming apparatus.

Further, since the recess (grip portion) is formed in the outer surface of the toner containing portion through the entire dimension thereof substantially in parallel with the axis of the electrophotographic photosensitive member, when the operator handles the process cartridge, the operator can hold the process cartridge by hooking his fingers on the recessed portion(s) of the recess corresponding to the fingers. Thus, the mounting/dismounting operability of the process cartridge can be improved.

Furthermore, since the recess (grip portion) is formed in the outer surface of the toner containing portion through the entire dimension thereof substantially in parallel with the axis of the electrophotographic photosensitive member and the force receiving portion capable of abutting against the process cartridge urging means of the apparatus body is also provided on the process cartridge, if the process cartridge is mounted to the apparatus body with a deviation from the predetermined mounting position, the process cartridge can be shifted to the predetermined mounting position by urging the process cartridge urging means against the force receiving portion.

As mentioned above, according to the present invention, the mounting/dismounting operability of the process cartridge with respect to the apparatus body can be improved.

What is claimed is:

1. A process cartridge detachably mountable to a main body of an electrophotographic image forming apparatus, comprising:

an electrophotographic photosensitive member;

developing means for developing a latent image formed on said electrophotographic photosensitive member with a toner;

a toner containing portion for containing the toner to be used by said developing means; and a recess formed in an outer surface of said toner containing portion along a direction transverse to a mounting direction along which said process cartridge is mounted onto and dismounted from said main body of said electrophotographic image forming apparatus for gripping said process cartridge;

wherein said recess has opening portions opened at both ends of said toner containing portion and communicates with said opening portions, and wherein said mounting direction is a direction transverse to an axis of said electrophotographic photosensitive member.

2. A process cartridge according to claim 1, further comprising a plurality of ribs, said ribs being formed on an outer surface of said toner containing portion opposite to said outer surface on which said recess is formed and being disposed side by side substantially in parallel with a longitudinal direction of said recess, wherein when said process cartridge is gripped, an operator grips said process cartridge with a hand of the operator across said recess and said ribs.

3. A process cartridge according to claim 1 or 2, further comprising a force receiving portion for receiving a force for moving said process cartridge to a predetermined mounting position when said process cartridge is mounted to the main body with deviation from said predetermined mounting position, and wherein said force receiving portion is disposed at a downstream side of said recess in the mounting direction of said process cartridge with respect to the main body and is capable of abutting against an inner surface of an opening/closing member of the main body when said opening/closing member is closed.

4. A process cartridge according to claim 3, wherein said force receiving portion is formed, contiguous to said recess, on a surface which becomes an upper surface when said process cartridge is mounted to the main body.

5. A process cartridge according to claim 3, further comprising a protruded portion provided on the inner surface of said opening/closing member, and wherein when said process cartridge is mounted to the main body to deviate from the predetermined mounting position, said protruded portion abuts against said force receiving portion as said opening/closing member is closed to thereby shift said process cartridge to the predetermined mounting position.

6. A process cartridge according to claim 1, wherein said recess has a central portion wider than both longitudinal end portions.

7. A process cartridge according to claim 1, further comprising at least one of a charge member for charging said electrophotographic photosensitive member and a cleaning member for removing residual toner remaining on said electrophotographic photosensitive member.

8. A process cartridge detachably mountable to a main body of an electrophotographic image forming apparatus, comprising:

an electrophotographic photosensitive member;

a developing member for developing a latent image formed on said electrophotographic photosensitive member with a toner;

a toner containing portion for containing the toner to be used by said developing member;

a recess formed in an outer surface of said toner containing portion along a direction transverse to a mounting direction along which said process cartridge is mounted onto and dismounted from said main body of said electrophotographic image forming apparatus for gripping said process cartridge;

wherein said recess extends from one end to the other end of said toner containing portion; and wherein said mounting direction is a direction transverse to an axis of said electrophotographic photosensitive member; and a plurality of auxiliary recessed portions formed on an inclined wall of said recess disposed at an upstream side in said mounting direction and disposed side by side in a direction transverse to a longitudinal direction of said recess, so that an operator's finger is positioned on at least one of said auxiliary recessed portions when gripping said process cartridge.

9. A process cartridge according to claim 8, further comprising a plurality of ribs, said ribs being formed on an outer surface of said toner containing portion opposite to said outer surface on which said recess is formed and being disposed side by side substantially in parallel with a longitudinal direction of said recess, wherein when said process cartridge is gripped, an operator grips said process cartridge with a hand of the operator across said recess and said ribs.

10. A process cartridge according to claim 8, further comprising a projection provided on a bottom of one longitudinal end portion of said recess, being configured and positioned to permit contact with an operator's finger when said process cartridge is gripped by the operator.

11. A process cartridge according to claim 8, further comprising a force receiving portion for receiving a force for moving said process cartridge to a predetermined mounting position when said process cartridge is mounted to the main body to deviate from said predetermined mounting position, and wherein said force receiving portion is disposed at a downstream side of said recess in the mounting direction of said process cartridge with respect to the main body and is capable of abutting against an inner surface of an opening/closing member of the main body when said opening/closing member is closed.

12. A process cartridge according to claim 11, wherein said force receiving portion is formed, contiguous to said recess, on a surface which becomes an upper surface when said process cartridge is mounted to the main body.

13. A process cartridge according to claim 11, further comprising a protruded portion provided on the inner surface of said opening/closing member, and wherein when said process cartridge is mounted to the main body to deviate from the predetermined mounting position, said protruded portion abuts against said force receiving portion as said opening/closing member is closed to thereby shift said process cartridge to the predetermined mounting position.

14. A process cartridge according to claim 8, wherein said recess has a central portion wider than both longitudinal end portions.

15. A process cartridge according to claim 14, further comprising at least one of a charge member for charging said electrophotographic photosensitive member and a cleaning member for removing residual toner remaining on said electrophotographic photosensitive member.

16. A process cartridge detachably mountable to a main body of an electrophotographic image forming apparatus, comprising:

an electrophotographic photosensitive member;

a developing member for developing a latent image formed on said electrophotographic photosensitive member with a toner;

a toner containing portion for containing the toner to be used by said developing member;

a recess formed in an outer surface of said toner containing portion along a direction transverse to a mounting direction along which said process cartridge is mounted onto and dismounted from said main body of said electrophotographic image forming apparatus for gripping said process cartridge;

wherein said recess extends from one end to the other end of said toner containing portion; and wherein said mounting direction is a direction transverse to an axis of said electrophotographic photosensitive member;

a plurality of ribs, said ribs being formed on an outer surface of said toner containing portion opposite to said outer surface on which said recess is formed and being disposed side by side substantially in parallel with a longitudinal direction of said recess, wherein when said process cartridge is gripped, an operator grips said process cartridge with a hand of the operator across said recess and said ribs; and a projection provided on a bottom of one longitudinal end portion of said recess, configured and positioned to permit contact with an operator's finger when said process cartridge is gripped by the operator.

17. A process cartridge according to claim 16, further comprising a plurality of auxiliary recessed portions formed on an inclined wall of said recess disposed at an upstream side in said mounting direction and disposed side by side in a direction transverse to a longitudinal direction of said recess, so that an operator's finger is positioned on at least one of said auxiliary recessed portions when gripping said process cartridge.

18. A process cartridge according to claim 16, further comprising a force receiving portion for receiving a force for moving said process cartridge to a predetermined mounting position when said process cartridge is mounted to the main body to deviate from said predetermined mounting position, and wherein said force receiving portion is disposed at a downstream side of said recess in the mounting direction of said process cartridge with respect to the main body and is capable of abutting against an inner surface of an opening/closing member of the main body when said opening/closing member is closed.

19. A process cartridge according to claim 18, wherein said force receiving portion is formed, contiguous to said recess, on a surface which becomes an upper surface when said process cartridge is mounted to the main body.

20. A process cartridge according to claim 18, further comprising a protruded portion provided on the inner surface of said opening/closing member, and wherein when said process cartridge is mounted to the main body to deviate from the predetermined mounting position, said protruded portion abuts against said force receiving portion as said opening/closing member is closed to thereby shift said process cartridge to the predetermined mounting position.

21. A process cartridge according to claim 16, wherein said recess has a central portion wider than both longitudinal end portions.

22. A process cartridge according to claim 21, further comprising at least one of a charge member for charging said electrophotographic photosensitive member and a cleaning member for removing residual toner remaining on said electrophotographic photosensitive member.

23. A process cartridge detachably mountable to a main body of an electrophotographic image forming apparatus, comprising:

an electrophotographic photosensitive drum;

a developing roller to supply a toner to said electrophotographic photosensitive drum by rotation thereof for developing a latent image formed on said electrophotographic photosensitive drum with the toner;

a charge member for charging said electrophotographic photosensitive drum;

a cleaning member for removing a residual toner remaining on said electrophotographic photosensitive drum;

a toner containing portion for containing the toner to be used by said developing roller;

a recess formed in an outer surface of said toner containing portion along a direction transverse to a mounting direction along which said process cartridge is mounted onto and dismounted from said main body of said electrophotographic image forming apparatus for gripping said process cartridge;

a plurality of ribs, said ribs being formed on an outer surface of said toner containing portion opposite to said outer surface on which said recess is formed and being disposed side by side substantially in parallel with a longitudinal direction of said recess, wherein when said process cartridge is gripped, an operator grips said process cartridge with a hand of the operator across said recess and said ribs; and a plurality of auxiliary recessed portions formed on an inclined wall of said recess disposed at an upstream side in said mounting direction and disposed side by side in a direction transverse to the longitudinal direction of said recess so that an operator's finger is positioned on at least one of said auxiliary recessed portions when gripping said process cartridge;

wherein said process cartridge can be gripped by hooking the operator's fingers to said recess and said ribs.

24. A process cartridge according to claim 23, further comprising a projection provided on a bottom of one longitudinal end portion of said recess, configured and positioned to permit contact with an operator's finger when said process cartridge is gripped by the operator.

25. A process cartridge according to claim 23 or 24, further comprising a force receiving portion for receiving a force for moving said process cartridge to a predetermined mounting position when said process cartridge is mounted to the main body to deviate from said predetermined mounting position, and wherein said force receiving portion is disposed at a downstream side of said recess in the mounting direction of said process cartridge with respect to the main body and is capable of abutting against an inner surface of an opening/closing member of the main body when said opening/closing member is closed.

26. A process cartridge according to claim 25, wherein said force receiving portion is formed, contiguous to said recess, on a surface which becomes an upper surface when said process cartridge is mounted to the main body.

27. A process cartridge according to claim 25, further comprising a protruded portion provided on the inner surface of said opening/closing member, and wherein when said process cartridge is mounted to the main body to deviate from the predetermined mounting position, said protruded portion abuts against said force receiving portion as said opening/closing member is closed to thereby shift said process cartridge to the predetermined mounting position.

28. A process cartridge according to claim 23, wherein said recess has a central portion that is wider than both longitudinal end portions.

29. A process cartridge detachably mountable to a main body of an electrophotographic image forming apparatus, comprising:

an electrophotographic photosensitive drum;

a developing roller to supply a toner to said electrophotographic photosensitive drum by rotation thereof for developing a latent image formed on said electrophotographic photosensitive drum with the toner;

a charge member for charging said electrophotographic photosensitive drum;

a cleaning member for removing a residual toner remaining on said electrophotographic photosensitive drum;

a toner containing portion for containing the toner to be used by said developing roller;

a recess formed in an outer surface of said toner containing portion along a direction transverse to a mounting direction along which said process cartridge is mounted onto and dismounted from, said main body of said electrophotographic image forming apparatus for gripping said process cartridge;

a plurality of ribs, said ribs being formed on an outer surface of said toner containing portion opposite to said outer surface on which said recess is formed and being disposed side by side substantially in parallel with a longitudinal direction of said recess, wherein when said process cartridge is gripped, an operator grips said process cartridge with a hand of the operator across said recess and said ribs;

a plurality of auxiliary recessed portions formed on an inclined wall of said recess disposed at an upstream side in said mounting direction and disposed side by side in a direction transverse to the longitudinal direction of said recess so that an operator's finger is positioned on at least one of said auxiliary recessed portions when gripping said process cartridge; and a force receiving portion for receiving a force for moving said process cartridge to a predetermined mounting position when the process cartridge is mounted to the main body to deviate from the predetermined mounting position, said force receiving portion being disposed at a downstream side of said recess in said mounting direction and being capable of abutting against an inner surface of an opening/closing member of the main body when said opening/closing member is closed;

wherein said process cartridge can be gripped by hooking the operator's fingers on said recess and said ribs.

30. A process cartridge according to claim 29, further comprising a projection provided on a bottom of one longitudinal end portion of said recess, configured and positioned to permit contact with an operator's finger when said process cartridge is gripped by the operator.

31. A process cartridge according to claim 29 or 17, wherein said force receiving portion is formed, contiguous to said recess, on a surface which becomes an upper surface when said process cartridge is mounted to the main body.

32. A process cartridge according to claim 29 or 30, further comprising a protruded portion provided on the inner surface of said opening/closing member, and wherein when said process cartridge is mounted to the main body to deviate from the predetermined mounting position, said protruded portion abuts against said force receiving portion as said opening/closing member is closed to thereby shift said process cartridge to the predetermined mounting position.

33. An electrophotographic image forming apparatus onto which a process cartridge is detachably mountable for forming an image on a recording medium, said electrophotographic image forming apparatus comprising:

(a) mount means for detachably mounting said process cartridge, said process cartridge including an electrophotographic photosensitive member; developing means for developing a latent image formed on said electrophotographic photosensitive member with a toner; a toner containing portion for containing the toner to be used by said developing means; and a recess formed in an outer surface of said toner containing portion along a direction transverse to a mounting direction along which said process cartridge is mounted onto and dismounted from said main body of said electrophotographic image forming apparatus for gripping said process cartridge; wherein said recess has opening portions opened at both ends of said toner containing portion and communicates with said opening portions, and said mounting direction is a direction transverse to an axis of said electrophotographic photosensitive member; and (b) convey means for conveying the recording medium.

34. An electrophotographic image forming apparatus onto which a process cartridge is detachably mountable for forming an image on a recording medium, said electrophotographic image forming apparatus comprising:

(a) mount means for detachably mounting the process cartridge, the process cartridge including: an electrophotographic photosensitive member; a developing member for developing a latent image formed on the electrophotographic photosensitive member with a toner; a toner containing portion for containing the toner to be used by the developing member; a recess formed in an outer surface of the toner containing portion along a direction transverse to a mounting direction along which said process cartridge is mounted onto and dismounted from said main body of said electrophotographic image forming apparatus for gripping the process cartridge, wherein the recess extends from one end to the other end of the toner containing portion, and wherein said mounting direction is a direction transverse to an axis of the electrophotographic photosensitive member; and a plurality of auxiliary recessed portions formed on an inclined wall of the recess disposed at a upstream side in said mounting direction and disposed side by side in a direction transverse to a longitudinal direction of said recess, so that an operator's finger is positioned on at least one of said auxiliary recessed portions when gripping said process cartridge; and (b) convey means for conveying the recording medium.

35. An electrophotographic image forming apparatus onto which a process cartridge is detachably mountable for forming an image on a recording medium, said electrophotographic image forming apparatus comprising:

(a) mount means for detachably mounting the process cartridge, the process cartridge including: an electrophotographic photosensitive member; a developing member for developing a latent image formed on said electrophotographic photosensitive member with a toner; a toner containing portion for containing the toner to be used by the developing member; a recess formed in an outer surface of the toner containing portion along a direction transverse to a mounting direction along which said process cartridge is mounted onto and dismounted from said main body of said electrophotographic image forming apparatus for gripping the process cartridge, wherein the recess extends from one end to the other end of the toner containing portion, and wherein said mounting direction is a direction transverse to an axis of the electrophotographic photosensitive member; a plurality of ribs being formed on an outer surface of the toner containing portion opposite to the outer surface on which the recess is formed and being disposed side by side substantially in parallel with a longitudinal direction of the recess, wherein when the process cartridge is gripped, an operator grips the process cartridge with a hand of the operator across the recess and the ribs; and a projection provided on a bottom of one longitudinal end portion of the recess, configured and positioned to permit contact with the operator's finger when the process cartridge is gripped by the operator; and (b) convey means for conveying the recording medium.

* * * * *

UNITED STATES PATENT AND TRADEMARK OFFICE

CERTIFICATE OF CORRECTION

PATENT NO. : 6,154,623
DATED : November 28, 2000
INVENTOR(S) : Akira Suzuki, et al.

It is certified that error appears in the above-identified patent and that said Letters Patent is hereby corrected as shown below:

Column 4,
Line 49, "the" (1st occurrence) should read -- be --.

Column 6,
Line 28, "are" should read -- is --.

Column 7,
Line 59, "his" should be deleted.

Column 8,
Line 25, "his" should be deleted.
Line 50, "dismount permitting" should read -- dismount-permitting --.

Column 9,
Line 22, "construction" should read -- constructions --.
Line 63, "a" should be deleted.

Column 11,
Lines 22 and 35, "16d1" should read -- 11d1 --.

Column 12,
Line 3, "his" should be deleted.
Line 26, "lid" should read -- 11d --.

Column 14,
Line 15, "portion 25" should read -- portion 26 --.
Line 66, "Illustrated" should read -- illustrated --.

Column 15,
Line 13, "mounted" should read -- be mounted --.

UNITED STATES PATENT AND TRADEMARK OFFICE

CERTIFICATE OF CORRECTION

PATENT NO. : 6,154,623
DATED : November 28, 2000
INVENTOR(S) : Akira Suzuki et al.

It is certified that error appears in the above-identified patent and that said Letters Patent is hereby corrected as shown below:

Column 20,
Line 38, "or 17," should read -- or 30, --.
Line 55, "including" should read -- including: --.

Column 21,
Line 29, "a" should read -- an --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*